United States Patent [19]

Bako

[11] 4,389,863

[45] Jun. 28, 1983

[54] COMBINATION LOCKS

[75] Inventor: Lazlo Bako, Woodcliff Lake, N.J.

[73] Assignee: Presto Lock, Inc., Garfield, N.J.

[21] Appl. No.: 240,849

[22] Filed: Mar. 5, 1981

[51] Int. Cl.[3] ..... E05B 37/02

[52] U.S. Cl. ..... 70/312; 70/317

[58] Field of Search ..... 70/315, 316, 317, 318, 70/312, 69–76

[56] References Cited

U.S. PATENT DOCUMENTS

| | | | |
|---|---|---|---|
| 3,633,388 | 1/1972 | Atkinson | 70/316 |
| 3,720,082 | 3/1973 | Feinberg et al. | 70/25 |
| 3,766,758 | 10/1973 | Heine et al. | 70/25 |
| 3,800,571 | 4/1974 | Heine | 70/71 |
| 4,048,821 | 9/1977 | Bako et al. | 70/25 |
| 4,123,923 | 11/1978 | Bako | 70/74 |

*Primary Examiner*—Robert L. Wolfe

*Attorney, Agent, or Firm*—Shapiro and Shapiro

[57] ABSTRACT

A combination lock having dial-driven sleeves mounted in axial alignment on a shaft is provided with a shift member to move the sleeves axially out of coupling engagement with the dials for changing the combination of the lock. The shift member includes a manual actuating portion extending through an opening in the face plate of the lock, and when the lock is on combination, the shift member can be moved transversely to the axis of the sleeves to effect uncoupling of the sleeves from the dials by a camming action.

6 Claims, 7 Drawing Figures

COMBINATION LOCKS

BACKGROUND OF THE INVENTION

The use of combination locks, which dispense with the need for a separate key, has in recent years become increasingly popular on articles such as luggage articles, camera and instrument cases, and the like.

Such locks commonly employ a mechanism whereby the combination of the lock can be changed to one of the user's own choice, by manipulation of a combination-changing device. In the case of locks, for example of the rotary dial and sleeve type, where for combination changing it is necessary to move the sleeves or other combination elements axially out of coupling engagement with the dials or the like, this is normally accomplished by a shift member having a manual actuator.

Until recently it was common practice for the actuator to be accessible only from the back of the lock, i.e., from the interior of the article to which the lock was applied, and, in certain instances, this proved to be cumbersome in operation. Further, the actuator generally needed to be moved in the axial direction of movement of the sleeves relative to the dials in order to uncouple the sleeves from the dials. (See, for example, U.S. Pat. No. 3,800,571 to Heine, issued Apr. 2, 1974, and commonly assigned herewith.)

In my copending patent applications Ser. Nos. 167,429; 167,430; 167,490; 167,914; and 167,919, all filed July 11, 1980 and commonly assigned herewith, I disclose shift mechanisms for combination locks all of which are operated by moving an actuator in a direction other than the axial direction of movement of the sleeves, and all of which can be operated from the exterior of an article to which the lock is applied. The present invention relates to a modified form of shift mechanism of this type.

It has previously been proposed in connection with combination padlocks, for example, which employ rotary dials and sleeves, to move the sleeves out of coupling engagement with the dials by utilizing the longer leg of the padlock shackle to provide axial movement of the sleeves by movement of the shackle in a direction other than the direction of axial movment of the sleeves. See, for example, U.S. Pat. No. 3,766,758 to Heine et al, issued Oct. 23, 1973, and U.S. Pat. No. 4,048,821 to Bako et al, issued Sept. 20, 1977. The present invention, however, is primarily concerned with providing alternative and simplified means for effecting axial movement of the combination elements, for combination changing purposes, by means of an actuator which is operated other than in the direction of movement of the elements.

SUMMARY OF THE INVENTION

In accordance with the invention, at least in a preferred embodiment thereof, axial movement of the combination elements of a combination lock, in order to effect a change in combination, is provided by moving a manual actuating portion of a shift member transversely to the axis of the elements, such movement of the actuating portion being converted through camming means into axial movement of the combination elements.

In a preferred form, the combination elements, such as combination sleeves in a sleeve and dial type lock, are carried end-to-end on a shaft in a lock casing and the shift member is mounted on one end of the shaft. The actuating portion extends through an opening, preferably in the face plate of the lock, and is guided for translatory movement transversely to the axis of the shaft. The shift member preferably includes a cam surface disposed obliquely to the axis of the shaft that cooperates with a complementary cam surface, for example on a shaft collar integral with the shaft, so that as the actuating portion is moved transversely, the cooperative cam surfaces effect axial movement of the shaft and thereby the sleeves to uncouple the sleeves from their respective dials.

The invention may be applied to locks having different forms of locking members, such as pivotal or sliding bolts, for example, and the shift member can be designed so that it can only be operated to move the combination elements axially for a combination change when the locking member is in an unlocked condition.

Additional features of the invention will be apparent from the ensuing description and claims taken in conjunction with the attached drawings.

DESCRIPTION OF PREFERRED EMBODIMENT

Figure 1:
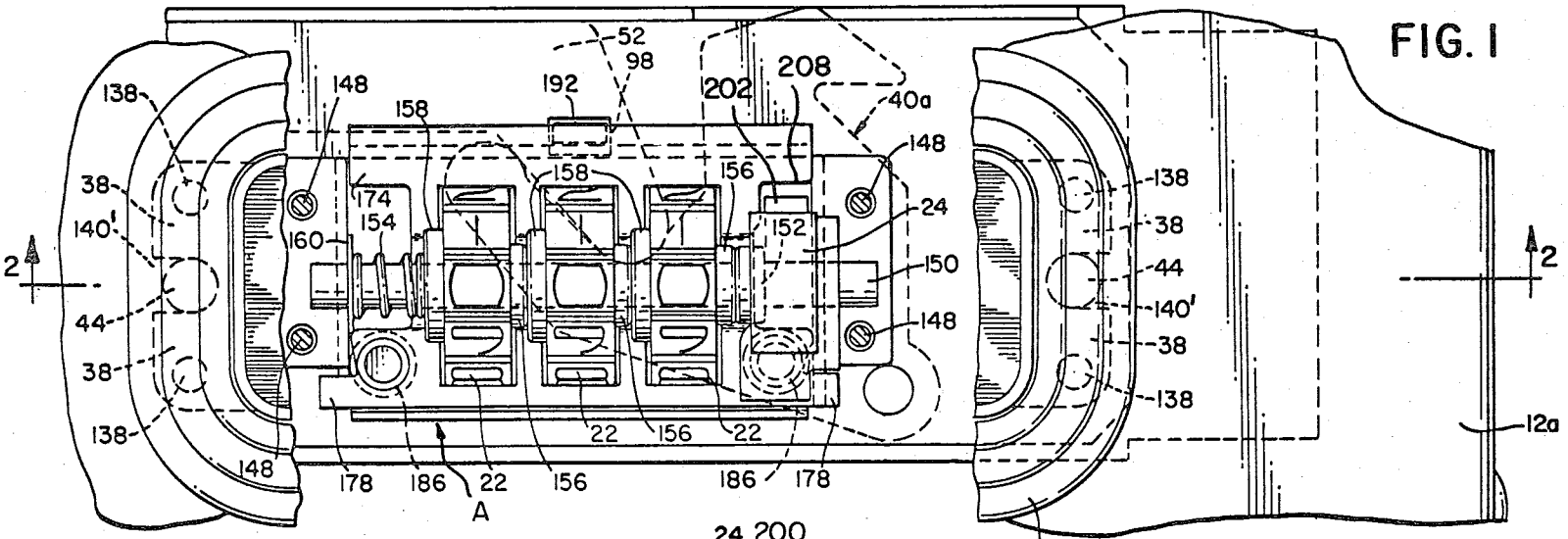
FIG. 1 is an elevational view, partly broken away, of a combination lock in accordance with the invention, shown in assembled relation with parts of a latching system and body section of an attache case.

For the purpose only of providing an illustrative example of one intended use of a lock in accordance with the invention, the lock is shown in the drawings in association with an attache case latching system of the type disclosed in copending U.S. patent application to Remington, titled "Improvements Relating to Luggage Latching Systems" which application is being filed concurrently herewith and which is commonly assigned herewith. It will be understood, however, that the latching system of the copending application forms no part of the present invention, and locks according to the present invention can be used in numerous other applications. Only those parts of the attache case and latching system necessary to an understanding of the present invention will therefore be described herein.

Figure 6:
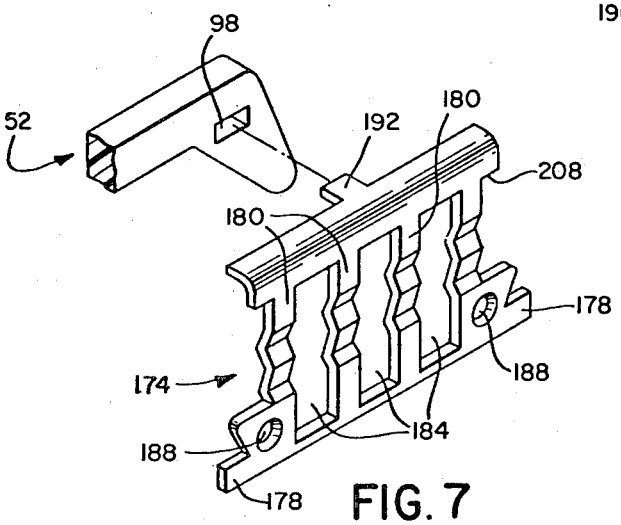
FIG. 6 is a perspective view of the lock bolt and part of a latch-operating slide rod.

The attache case is understood to have a main body section and a hinged lid. Along the interior of a front wall 12*a* of the body section is fastened an elongate latch console including a base plate 50, a pair of spaced pivotal latches, only one (40*a*) of which is shown, and an elongate slide rod 52 (see FIGS. 1 and 6) for operating the latches. The latches engage fixed hasps on the lid of the case and the slide rod is used to move the latches by a camming action from hasp-engaging to hasp-disengaging positions, to allow the case to be opened.

Lock A in accordance with the invention is attached to the latch console and projects through an opening in wall 12*a*. An escutcheon plate 26*a* frames the opening around the lock and screws 44 attach the escutcheon plate to the latch console. The lock includes a pivoting bolt 174 with a tab 192 adapted to enter an opening 98 in slide rod 52 when the lock is off combination, to lock the rod and prevent the latches being operated. When the lock is on combination, tab 192 is removed from opening 98 to allow for movement of rod 52. Details of lock A will now be described.

The lock has a main body member 136 integrally formed with mounting flanges 38 which may have screw openings 138 for attachment of the lock assembly to the latch console or alternatively, the flanges may have shanks for riveting the assembly to the console. Openings 140' between flanges 38 provide passage for the escutcheon plate fastening screws 44.

The outer wall 140 of member 136, which may be provided with a cover sheet 212, forms a face plate of the lock and is provided with openings 142 (see FIG. 2) for respective combination dials 22 and a further opening 144 for a shift member 24. A dished cover plate 146 is secured internally to body member 136 (by suitable fasteners 148) to define with the body member a lock casing. A shaft 150 is mounted within the casing on suitable support surfaces of the body member and cover plate, the shaft having an integral or fixed collar 152 adjacent one end. Carried on the shaft, between collar 152 and a coil compression spring 154, are axially abutting combination elements in the form of sleeves 156, the left ends of which are formed as cams 158. On the opposite side of collar 152, shaft 150 carries the shift member 24. Spring 154 acts between a washer 160 and the endmost sleeve to urge the assembly of shaft, sleeves, and shift member to the right.

Figure 7:
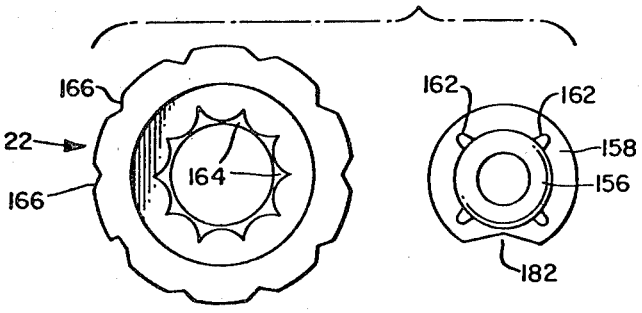
FIG. 7 is a composite end view of a combination dial and combination sleeve.

The sleeves are each encircled in known manner by one of the dials 22 (constituting cooparative combination components of the lock), the sleeves being coupled for rotation with the dials by means of sleeve teeth 162 engaging openings 164 in their respective dials (see FIG. 7). The dials each have a peripheral series of combination indicia with detents 166 therebetween, and a dial spring 170 on the base of cover plate 146 has pairs of arms 172 arranged (see FIG. 3) for engaging the detents, so that the dials may be manually rotated in equal increments between the respective indicia settings.

The bolt 174 (see particularly FIG. 6) is pivotally mounted within the lock casing by means of projecting ears 178 carried in suitable openings (not shown) in opposite end walls of cover plate 146. The bolt has cross-bars 180 formed with V-shaped ridges adapted to engage in corresponding V-shaped notches 182 in the cams 158 (see FIGS. 3 and 7). Slots 184 between the bolt cross-bars accommodate the dials.

Figure 2:
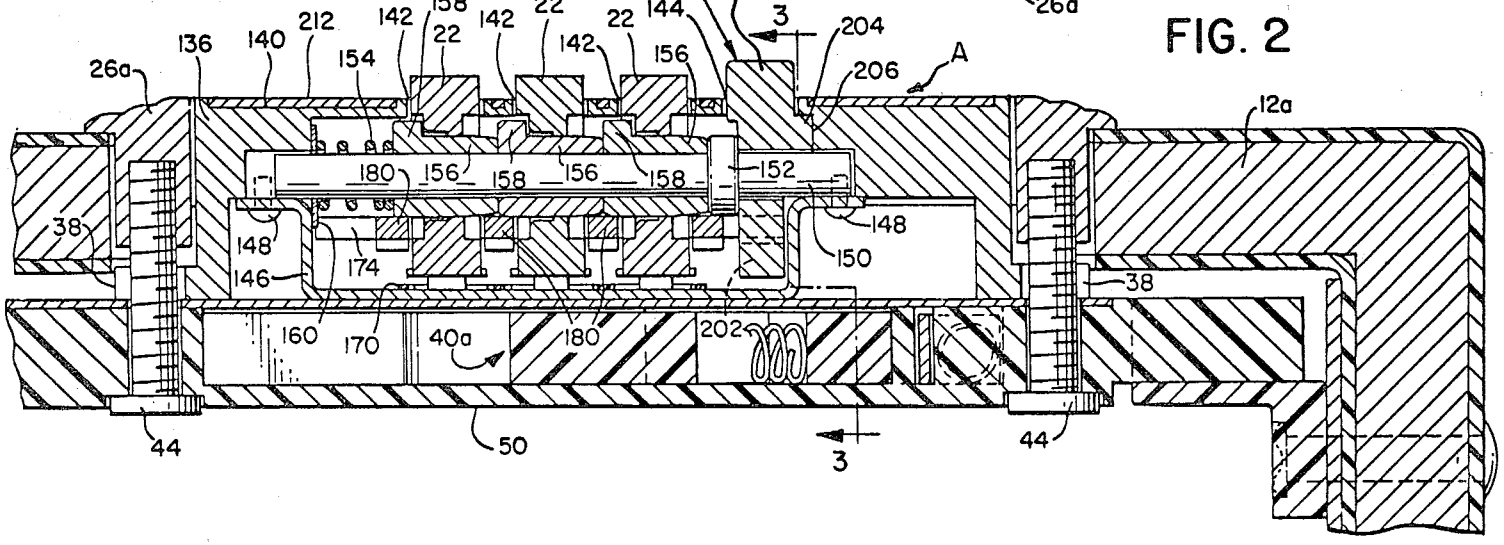
FIG. 2 is a sectional view on line 2—2 of FIG. 1.

The bolt is urged upwardly by means of bolt springs 186 on the base of cover plate 146, the springs being located on bolt bosses 188, so that the ridge portions of the cross-bars contact the peripheries of the cams 158. When all the cams are aligned so that the bolt ridges are all received in the respective cam notches (the on-combination setting of the lock) the bolt is raised under the influence of springs 186 as shown in FIGS. 2 and 3.

Figure 3:
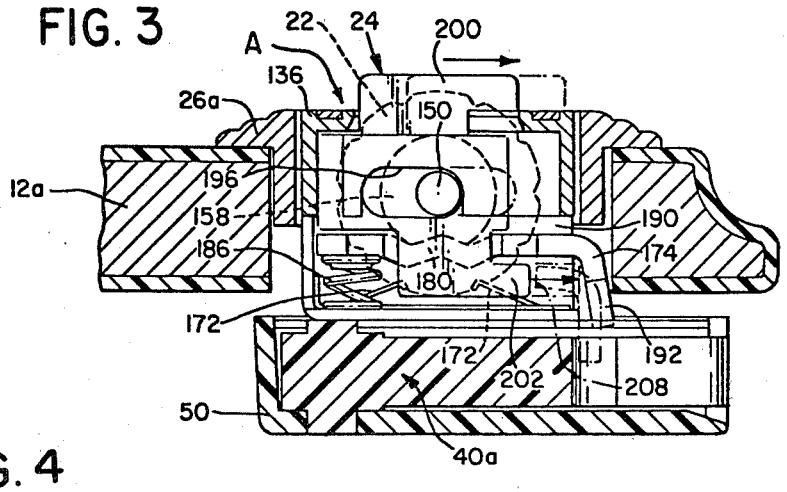
FIG. 3 is a sectional view on line 3—3 of FIG. 1.

When, however, any one or more of the cams is rotated by one or more dial-indicium settings away from the on-combination setting, the relevant ridge portion of the bolt is moved out of its respective notch by a camming action, so that the bolt is lowered to the position shown in phantom in FIG. 3, the ridge portion then engaging the circular periphery of the respective cam. (A more detailed description of a lock of this nature is contained in copending U.S. patent application Ser. No. 033,540 to Remington, filed Apr. 26, 1979, and commonly assigned herewith. The entire disclosure of the copending application is incorporated herein by reference.)

The free edge of the bolt opposite pivots 178 is bent down and projects through an opening 190 on one side of the lock casing. Tab 192 forming the locking member for slide rod 52 of the latch console is provided on the free edge.

Shift member 24 is provided for changing the set combination of the lock by uncoupling the sleeves from the dials when the lock is on-combination, allowing one or more of the dials to be rotated relative to the associated sleeve or sleeves. As seen more particularly in FIG. 5, the shift member has a body section 194 defining a transverse slot 196 through which shaft 150 passes when the lock is assembled, a cam surface 198, a manual actuating portion 200 projecting through opening 144 in the lock face plate, and a blocking portion 202. A rear section 204 of the body portion 194 fits in a recess 206 in body member 136 of the lock (see FIGS. 2 and 4) to locate and guide the shift member for translatory movement transversely of the shaft.

Figure 4:
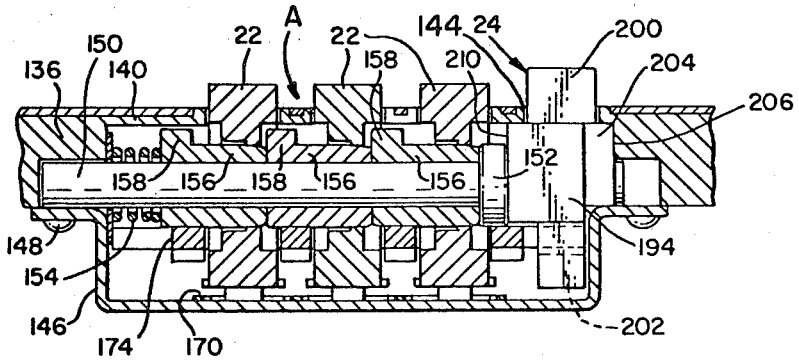
FIG. 4 is a view similar to FIG. 2 showing the lock in a combination-changing position.
Figure 5:
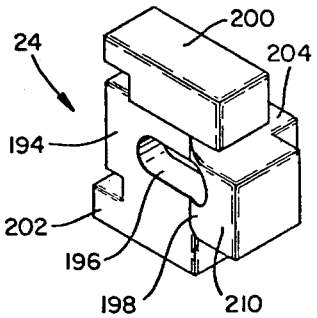
FIG. 5 is a perspective view of a shift member of the lock.

When the lock bolt is lowered, the lock being off combination in the locked condition, an edge surface 208 of the bolt (see FIGS. 1, 3 and 6) is in blocking relationship to blocking section 202 of the shift member, to prevent the member from being moved transversely. When the lock is on combination in the unlocked condition, however, and the bolt is raised, surface 208 clears blocking section 202 and the shift member can be moved transversely to the right via the actuating portion, in a direction parallel to face plate 140 as shown in FIG. 3. This movement effects a camming action between surface 198 of the shift member and shaft collar 152, shifting the shaft and sleeves to the left as seen in FIG. 2, so that the sleeves are uncoupled from the dials. The shifted position of the lock is shown in FIG. 4. In this position, shaft collar 152 engages a flat surface 210 of the shift member to prevent spring 154 from forcing the sleeves and the shaft back into the FIG. 2 position. Accordingly, the shift member can be released and the lock's combination can be adjusted. It will also be noted that in the shifted position, blocking section 202 of the shift member sits under the bolt, thereby preventing the bolt from being lowered and avoiding a possible loss of the set combination.

After the combination has been adjusted, the shift member can be returned to its initial position, thereby allowing spring 154 to force the sleeves back into coupling engagement with the dials and setting the new combination.

It will be seen from the foregoing that the invention provides a convenient form of shift member for use with combination locks, suitable for application to articles of luggage and the like, which shift member can be operated from the top of the lock casing, i.e., externally of the article to which the lock is applied. Further, the shift member is operated by moving a manual actuating portion in a direction different from the direction of movement of the combination elements that are moved.

While the invention has been described specifically in relation to a lock having a pivotal bolt which extends out of the lock casing for movement into and out of locking engagement with an external member (the latch console slide rod), the invention is not restricted to this application and can also be used for other types of locks. For example, the invention may be applied to a lock adapted for use with a hasp which is inserted into and removed from the lock casing through a suitable opening, the bolt being movable into and out of blocking relationship with the hasp. Alternatively, the invention may also be applied to locks of the type in which a latching member adapted to engage and disengage a hasp is operated by a manual actuator and the combination elements are adapted to block or release the actuator for moving the latching member.

While only a single preferred embodiment of the invention has been described herein in detail, it is to be understood that the invention is not limited thereby and modifications can be made within the scope of the attached claims.

I claim:

1. A combination lock including a plurality of combination elements disposed coaxially on a shaft in a lock casing for axial movement in unison out of coupling engagement with cooperating combination components in order to change the combination of the lock, and a shift member mounted on said shaft adjacent a terminal one of said combination elements, said shift member including an elongate opening receiving said shaft, a manual actuating portion projecting through an opening in a wall forming part of the lock casing, and means guiding said shift member for translatory movement substantially transversely to the axis of said shaft and in a direction substantially parallel to said wall responsive to corresponding transverse movement of said actuating portion in said opening, said shift member further including a cam surface for moving said elements axially responsive to translatory movement of the shift member.

2. A lock as defined in claim 1, including a bolt defining a locking member controlled by said combination elements for movement between locked and unlocked positions, said shift member including a blocking portion adapted to engage said bolt when the bolt is in the locked position for inhibiting movement of the shift member, said blocking portion clearing said bolt when the bolt is in the unlocked position.

3. A lock as defined in claim 2, wherein said shift member has a terminal position for holding said combination elements in a combination changing position, said blocking portion engaging said bolt in the terminal position of said shift member to retain the bolt in the unlocked position.

4. A lock as defined in claim 1, wherein said combination elements comprise sleeves mounted axially in abutting relation on said shaft, the cooperating combination components comprising dials encircling said sleeves, said dials having peripheral portions extending through slots in the wall of the lock, and said opening is formed.

5. A lock as defined in claim 1, including a collar on said shaft between said terminal one of said combination elements and said shift member, said shift member engaging said collar to move said shaft and said elements axially responsive to movement of said actuating portion in said opening.

6. A lock as defined in claim 2, wherein said locking member is a pivotal bolt and said sleeves each include a cam having a cam surface engaging said bolt for controlling movement of the bolt between said locked and unlocked positions dependent upon the alignment of the respective cam surfaces.

* * * * *